US012324485B2

(12) United States Patent
Nakaya et al.

(10) Patent No.: US 12,324,485 B2
(45) Date of Patent: Jun. 10, 2025

(54) SHOE

(71) Applicant: ASICS CORPORATION, Kobe (JP)

(72) Inventors: Seigo Nakaya, Kobe (JP); Masanori Sakaguchi, Kobe (JP); Kenta Moriyasu, Kobe (JP); Genki Hatano, Kobe (JP); Sho Takamasu, Kobe (JP); Kenji Hirata, Kobe (JP); Takayuki Kogure, Kobe (JP)

(73) Assignee: ASICS CORPORATION, Kobe (JP)

( * ) Notice: Subject to any disclaimer, the term of this patent is extended or adjusted under 35 U.S.C. 154(b) by 389 days.

(21) Appl. No.: 17/418,633

(22) PCT Filed: Dec. 28, 2018

(86) PCT No.: PCT/JP2018/048615

§ 371 (c)(1),
(2) Date: Jun. 25, 2021

(87) PCT Pub. No.: WO2020/136914

PCT Pub. Date: Jul. 2, 2020

(65) Prior Publication Data

US 2022/0061454 A1 Mar. 3, 2022

(51) Int. Cl.
*A43B 7/142* (2022.01)
*A43B 7/08* (2022.01)
(Continued)

(52) U.S. Cl.
CPC ..... *A43B 7/142* (2013.01); *A43B 7/088* (2013.01); *A43B 7/143* (2013.01); *A43B 13/127* (2013.01); *A43B 13/141* (2013.01); *A43B 13/186* (2013.01)

(58) Field of Classification Search
CPC ... A43B 13/186; A43B 13/125; A43B 13/181; A43B 7/1445; A43B 7/143; A43B 7/142;
(Continued)

(56) References Cited

U.S. PATENT DOCUMENTS 1,232,509 A * 7/1917 Davis ..... A43B 13/223 36/32 R
1,872,604 A * 8/1932 Pierce ..... A43B 13/12 36/31
(Continued)

FOREIGN PATENT DOCUMENTS

CN 107772637 A 3/2018
EP 2979568 B1 5/2018
(Continued)

OTHER PUBLICATIONS

International Preliminary Report on Patentability (IPRP) for International Application No. PCT/JP2018/048615, dated Jun. 16, 2021, 9 pp. (w/ Translation) [300.03PCT (IPRP)].
(Continued)

*Primary Examiner* — Khoa D Huynh
*Assistant Examiner* — Grady Alexander Nunnery
(74) *Attorney, Agent, or Firm* — Konrad, Raynes, Davda & Victor LLP; Alan S. Raynes

(57) ABSTRACT

The shoe 100 includes the outer sole 10 brought in contact with the road surface, the midsole 20 arranged on the outer sole 10, and the upper 9 covering the foot from the upper side. The midsole 20 includes at the middle foot portion the cut-out portion 21 and the like opened to the outside and closed at the middle portion in the width direction.

12 Claims, 13 Drawing Sheets

(51) Int. Cl.

| | |
|---|---|
| ***A43B 7/143*** | (2022.01) |
| ***A43B 13/12*** | (2006.01) |
| ***A43B 13/14*** | (2006.01) |
| ***A43B 13/18*** | (2006.01) |

(58) Field of Classification Search
CPC ..... A43B 13/12; A43B 13/122; A43B 13/023; A43B 13/16; A43B 13/14; A43B 7/088; A43B 13/146; A43B 13/141; A43B 13/183
See application file for complete search history.

(56) References Cited

U.S. PATENT DOCUMENTS

| | | | | |
|---|---|---|---|---|
| 4,316,334 | A * | 2/1982 | Hunt | A43B 7/22 36/75 R |
| 2003/0005600 | A1 | 1/2003 | Kita | |
| 2006/0137228 | A1 | 6/2006 | Kubo et al. | |
| 2007/0051013 | A1* | 3/2007 | Akhidime | A43B 7/088 36/3 B |
| 2007/0193065 | A1 | 8/2007 | Nishiwaki et al. | |
| 2009/0049712 | A1 | 2/2009 | Steszyn et al. | |
| 2010/0236096 | A1* | 9/2010 | Pauk | A43B 13/125 36/28 |
| 2011/0138651 | A1 | 6/2011 | Nishiwaki et al. | |
| 2011/0138652 | A1* | 6/2011 | Lucas | A43B 13/14 36/28 |
| 2016/0058122 | A1* | 3/2016 | Foxen | A43B 13/181 36/28 |
| 2016/0150854 | A1 | 6/2016 | Hockerson et al. | |
| 2016/0270475 | A1* | 9/2016 | Foxen | A43B 13/42 |
| 2019/0116928 | A1* | 4/2019 | Yahata | A43B 13/14 |

FOREIGN PATENT DOCUMENTS

| | | | |
|---|---|---|---|
| JP | 2003019004 | A | 1/2003 |
| JP | 2010536505 | A | 12/2010 |
| WO | 2005037002 | A | 4/2005 |
| WO | 2006038338 | A1 | 4/2006 |
| WO | 2014155511 | A1 | 10/2014 |

OTHER PUBLICATIONS

International Search Report for International Application No. PCT/JP2018/048615, dated Feb. 26, 2019, 3 pp. (w/ Translation) [300.03PCT (ISR)].
European Search Report for EP Application No. 18944648.7, dated Nov. 26, 2021, 8 pp.

* cited by examiner

SHOE

TECHNICAL FIELD

The present invention relates to a shoe worn for sports and the like.

BACKGROUND ART

A shoe worn for sports and the like preferably follows movement of a foot part of a wearer and supports the foot firmly when the wearer performs walking, running, exercise, and the like.

For example, patent document 1 discloses a sole including a reinforcing member reinforcing a part of a midsole. The reinforcing member is arranged so that a bottom surface of a first arch and a top surface of a second arch are opposite to each other. At least a part of the bottom surface of the first arch is in vertically spaced relationship with a part of the top surface of the second arch and not in contact therewith. The first arch and the second arch are formed from medial side to lateral side of the sole, and a medial surface and a lateral surface are closed.

RELATED ART DOCUMENT

Patent Document

[patent document 1] WO 2005/037002 A

SUMMARY OF THE INVENTION

Problem to be Solved by the Invention

Meanwhile, when the wearer puts on a shoe, the shoe fits the wearer's foot by tying shoelaces or the like. The present inventor has arrived at the following discovery in terms of fitting of the shoe to the foot. That is, by tying the shoelaces, an arch portion of the foot sinks along a sole, and a height of a medial arch is lowered, which causes a spring function and a cushion function of the medial arch to be lowered.

In the sole described in patent document 1, since the medial surface of the first arch and the second arch is closed, rigidity of the medial side portion of the midsole tends to increase. Thus, the present inventor has found that a fitting feature of the sole to the arch portion of the foot is limited and leaves room for improvement.

The present invention is accomplished by taking such problems as mentioned above into consideration thereof, and an object thereof is to provide a shoe enabling sinking of an arch part of a foot to be reduced.

Means to Solve the Problem

An aspect of the present invention is a shoe. A shoe includes an outer sole brought in contact with a road surface, a midsole arranged on the outer sole, and an upper covering a foot from an upper side. The midsole includes at a middle foot portion a cut-out portion opened to a lateral side and closed at a middle portion in a width direction.

Note that arbitrary combination of the above components, and mutual substitution of the components and expressions of the present invention among a method, an apparatus, and the like are valid as aspects of the present invention.

Effect of the Invention

According to the present invention, sinking of an arch part of a foot can be reduced.

MODE FOR CARRYING OUT THE INVENTION

Figure 1:
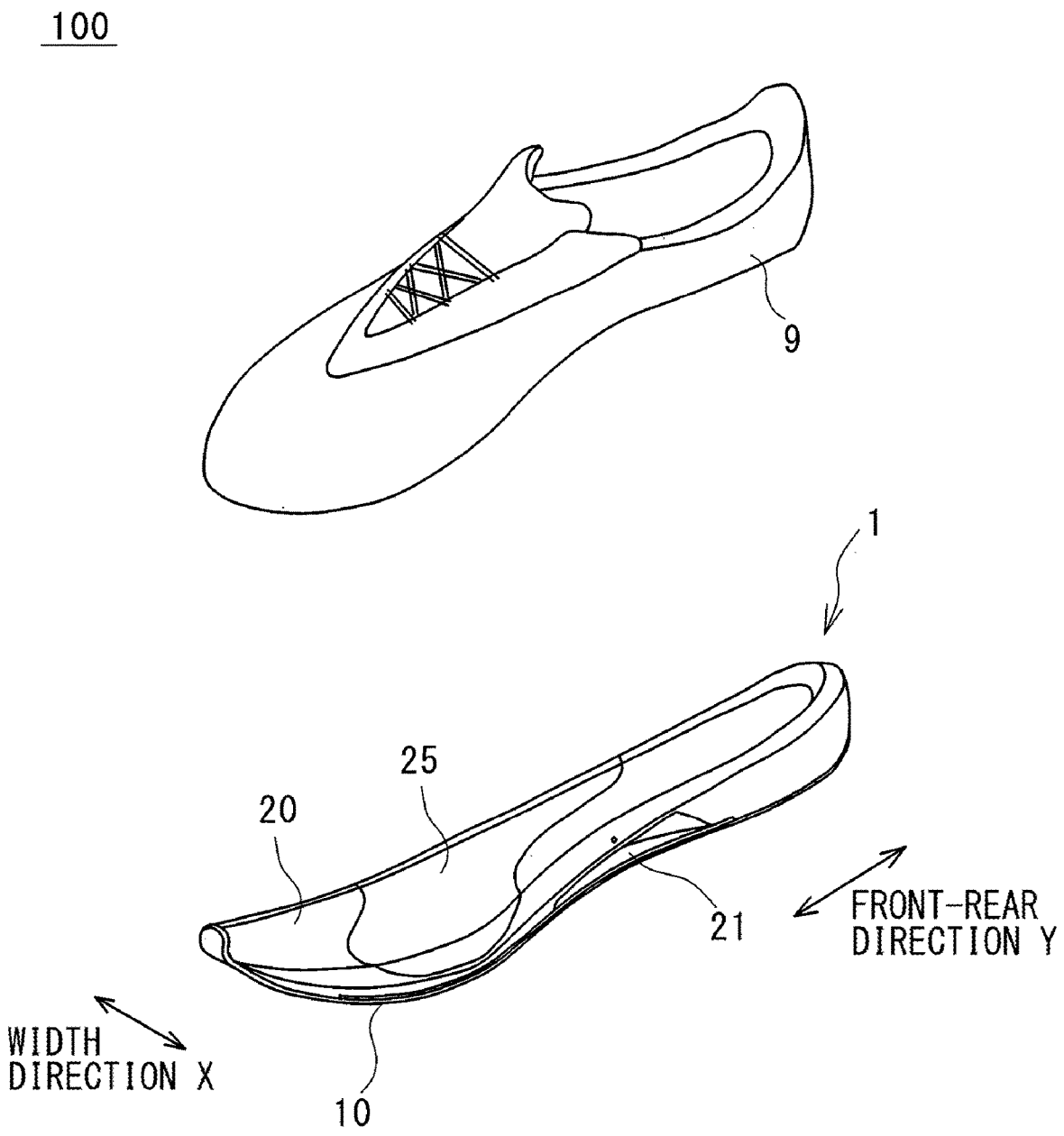
FIG. 1 is an exploded perspective view illustrating an external view of a shoe according to a first embodiment.

Hereinbelow, the present invention will be described based on preferred embodiments with reference to FIGS. 1 through 13B. Similar or identical components and members illustrated in the respective figures are labeled with the same reference numerals, and description of the duplicate components is omitted as needed. Also, a dimension of a member in each figure is enlarged or shrunk as needed to facilitate understanding. Also, some members that are less relevant to describe the embodiment in each figure are omitted.

First Embodiment

FIG. 1 is an exploded perspective view illustrating an external view of a shoe 100 according to a first embodiment. The shoe 100 includes an upper 9 and a sole 1. The upper 9 is attached or sewn to a rim portion of the sole 1 to cover an upper side of a foot. The sole 1 includes an outer sole 10, a midsole 20, and the like and is formed by piling the midsole 20 on the outer sole 10 and piling a not-illustrated insole or the like on the midsole 20.

Figure 2:
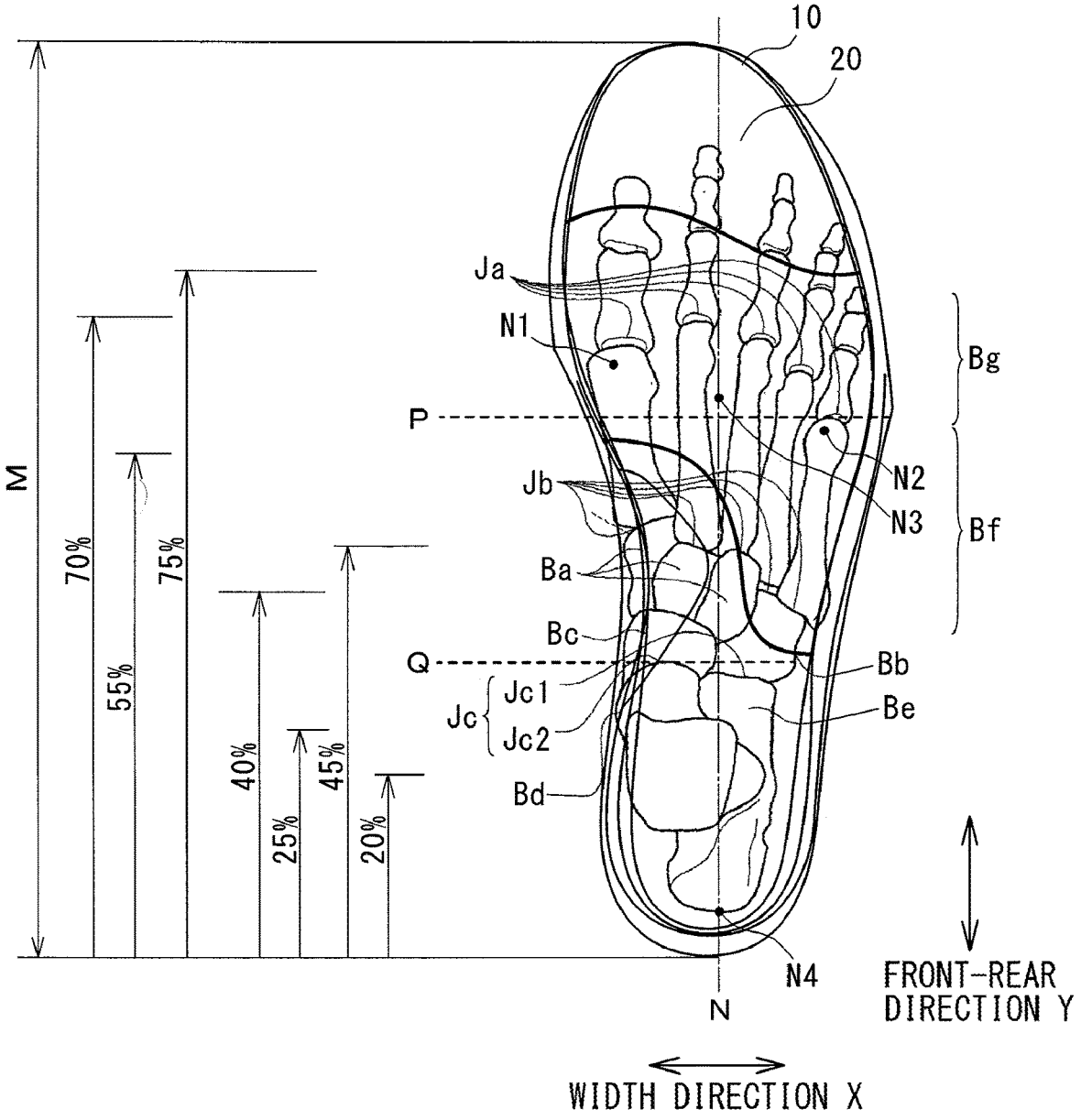
FIG. 2 is a schematic view in which a skeleton model of a foot of a human body overlaps with a plan view of a sole.

FIG. 2 is a schematic view in which a skeleton model of a foot of a human body overlaps with a plan view of the sole 1. The foot of the human body mainly includes a cuneiform bone Ba, a cuboid bone Bb, a navicular bone Bc, a talus bone Bd, a calcaneus Be, a metatarsal bone Bf, and a phalanx bone Bg. Joints of the foot include an MP joint Ja, a Lisfranc joint Jb, and a Chopart joint Jc. The Chopart joint Jc includes a calcaneocuboid joint Jc1 formed by the cuboid bone Bb and the calcaneus Be and a talonavicular joint Jc2 formed by the navicular bone Bc and the talus bone Bd.

In the present invention, a center line N of the foot is expressed by a straight line connecting a midpoint N3 between a thenar center N1 and a hypothenar center N2 to a heel center N4. For example, a front-rear direction Y is parallel to the center line N, and a width direction X is perpendicular to the center line N. A straight line along the width direction X (a direction perpendicular to the center line N) assumed to pass an end of the MP joint Ja on the heel side is referred to as a line P. Also, a straight line along the width direction X assumed to pass an end of the Chopart joint Jc of the wearer on the toe side is referred to as a line Q. Here, a front foot portion means a region from the line P to the toe side, a middle foot portion means a region from the line P to the line Q, and a rear foot portion means a region from the line Q to the heel side. As for relationships between the line P and the shoe 100 and the line Q and the shoe 100, the line P is located at a position of 40% to 75% of an entire length M of the shoe 100 from a rear end on the heel side in the direction of the center line N, for example. More preferably, the line P is located at a position of 55% to 70% from a rear end. Also, the line Q is located at a position of 20% to 45% of the entire length M of the shoe 100 from the rear end on the heel side in the direction of the center line N. More preferably, the line Q is located at a position of 25% to 40% from a rear end.

Figure 3:
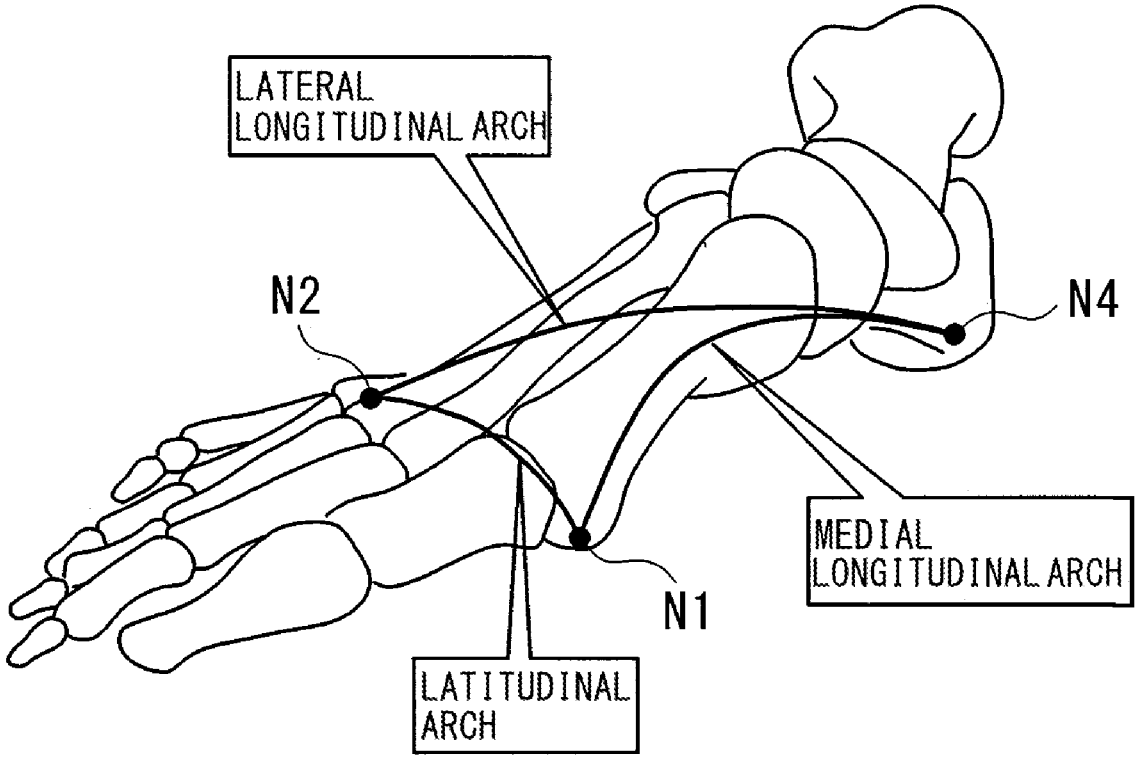
FIG. 3 is a perspective view of the skeleton model of the foot.

FIG. 3 is a perspective view of the skeleton model of the foot. The foot has an arch structure formed by three points of the thenar center N1, the hypothenar center N2, and the heel center N4. A medial longitudinal arch is formed between the thenar center N1 and the heel center N4, and a lateral longitudinal arch is formed between the hypothenar center N2 and the heel center N4. Also, a latitudinal arch is formed between the thenar center N1 and the hypothenar center N2. In particular, a bottom of the foot at the medial longitudinal arch is an arch portion spaced from a ground surface.

Figure 4:
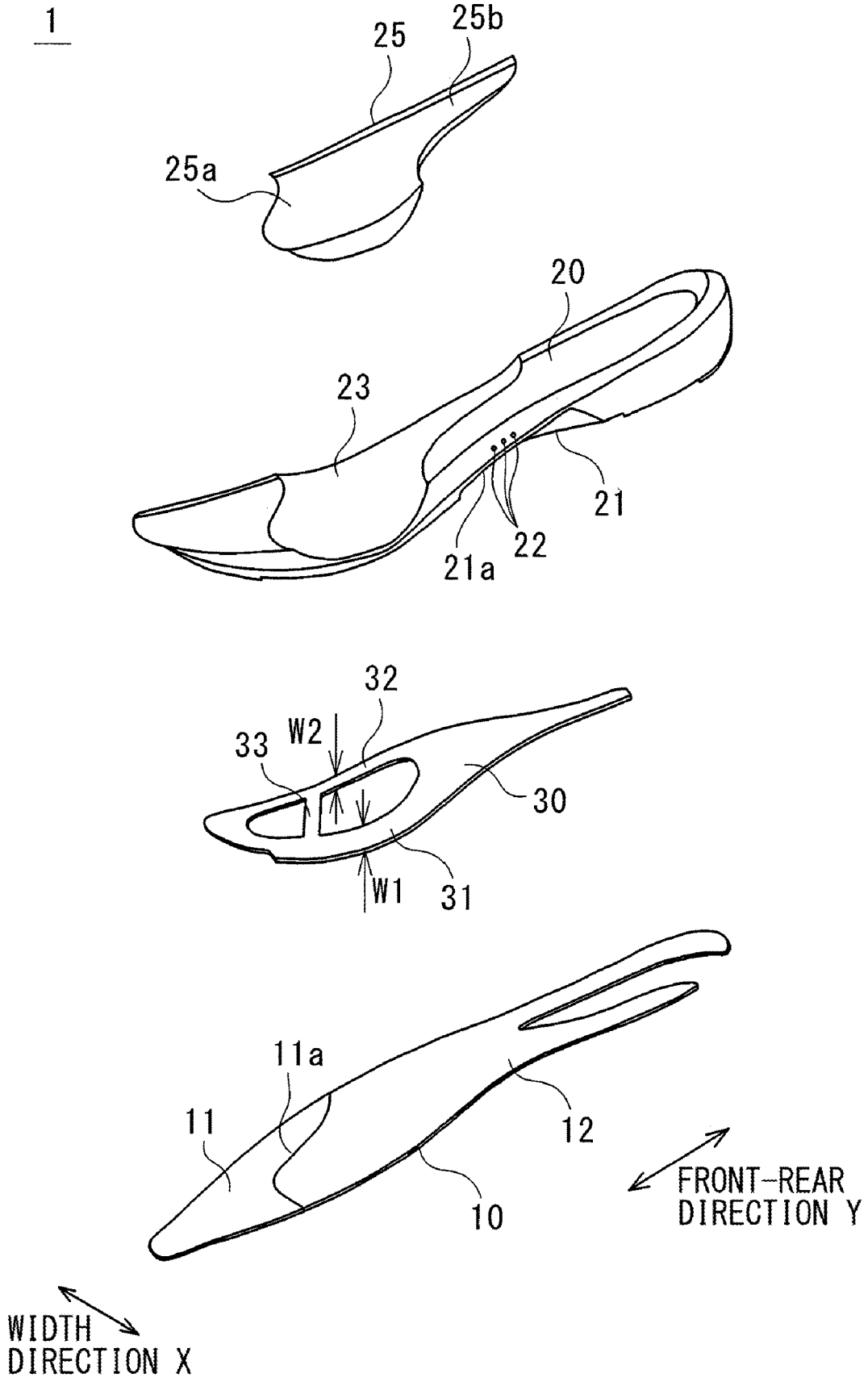
FIG. 4 is an exploded perspective view of the sole.

FIG. 4 is an exploded perspective view of the sole 1. In the outer sole 10, a bottom surface part to be brought in contact with the road surface is formed to be as long as an entire length of the foot in the front-rear direction Y, and a toe side is curled up to a higher position than a heel side to make the foot move smoothly from landing to kicking. The outer sole 10 is made of rubber, for example, absorbs unevenness of the road surface and the like, and has abrasion resistance and durability. The outer sole 10 includes a toe sole portion 11 arranged at a toe part and excellent in a grip characteristic and a sole main body portion 12 connected to a rear part of the toe sole portion 11 and lighter than the toe sole portion 11. A rear edge 11*a* of the toe sole portion 11 is inclined to extend backward from a thenar side to a hypothenar side. In this manner, since the toe sole portion 11 and the sole main body portion 12 are made of materials having different characteristics, mobility of the foot can be improved in accordance with the event in which the shoe is used.

The midsole 20 is arranged on the outer sole 10 and is formed from the toe to the heel. On the medial side of the middle foot portion of the midsole 20, a cut-out portion 21 is formed. The cut-out portion 21 is formed in a manner of being drilled from the medial side of the middle foot portion with an upper surface portion 21*a* left, and the medial side and the bottom side are opened.

Figure 5:
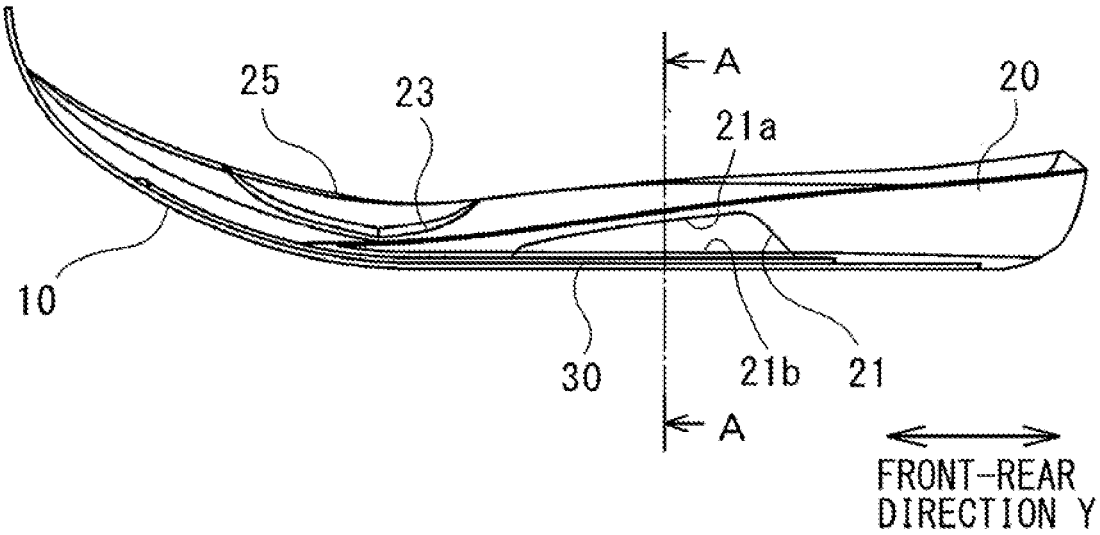
FIG. 5 is a side view of medial side of the sole.
Figure 6:
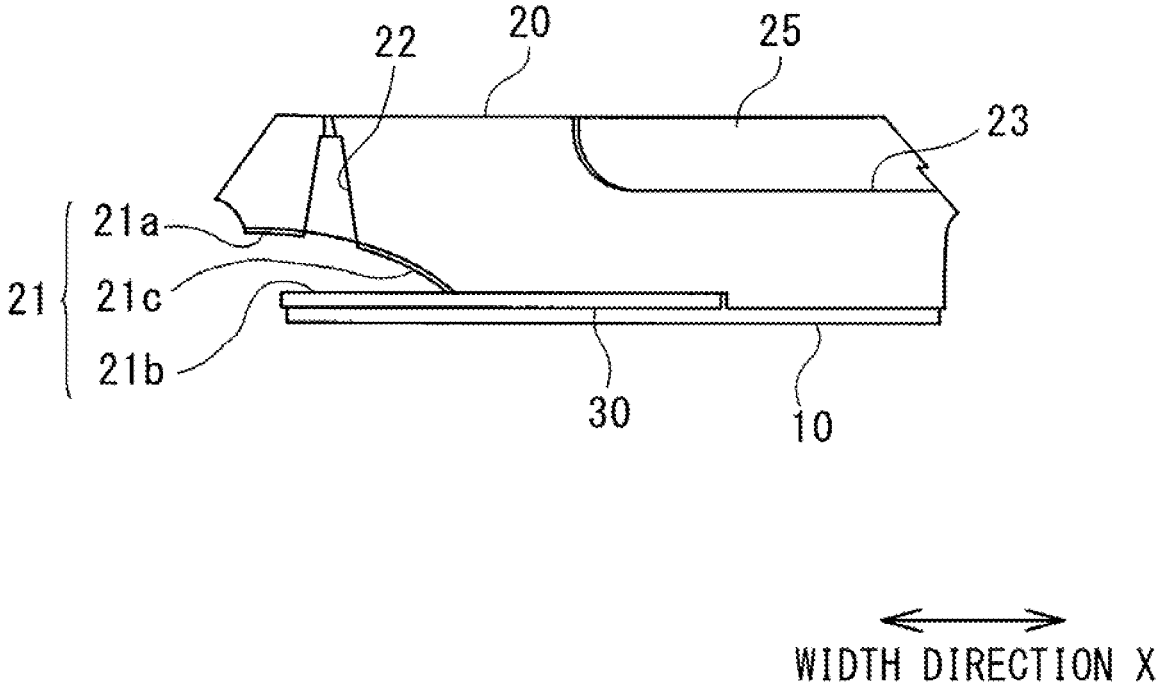
FIG. 6 is a cross-sectional view of the sole along the line A-A illustrated in FIG. 5.

FIG. 5 is a side view of medial side of the sole 1, and FIG. 6 is a cross-sectional view of the sole 1 along the line A-A illustrated in FIG. 5. The bottom side of the cut-out portion 21 is provided with a lower surface portion 21*b* by a plate member 30 arranged along a lower surface of the midsole 20 and is closed. Hence, the cut-out portion 21 provided at the medial side portion of the midsole 20 is closed at the upper and lower sides by the upper surface portion 21*a* and the lower surface portion 21*b* and is formed in a recessed shape opened to the medial side.

The upper surface portion 21*a* is inclined to go upward from a front portion to a rear side and, at a rear portion, is inclined to go downward to the rear side. The upper surface portion 21*a* may be formed in a linear or curved shape or in an uneven line or the like as seen from the medial side. A back portion 21*c* of the cut-out portion 21 is closed at a middle portion in the width direction X. In a case in which the back portion 21*c* is hollowed without the middle portion closed, the entire foot sinks downward at the time of landing. However, in a case in which the middle portion is closed as in the present embodiment, sinking of the foot can appropriately be reduced. The upper surface portion 21*a* of the cut-out portion 21 is inclined to go downward toward the back portion 21*c*, and a vent hole 22 is formed to penetrate the midsole 20 upward from the upper surface portion 21*a*. The upper surface portion 21*a* may be provided with a projecting portion (not illustrated) projecting downward. Due to the projecting portion, sinking of the upper surface portion 21*a* downward is reduced. Also, by providing the projecting portion further on the medial side in the width direction X than the vent hole 22, water entry into the vent hole 22 is suppressed. Similarly, the lower surface portion 21*b* may be provided with a projecting portion (not illustrated) projecting upward. Due to the projecting portion, a deformation suppressing effect at the lower surface portion 21*b* is improved. Also, by providing the projecting portion further on the medial side in the width direction X than the vent hole 22, water entry into the vent hole 22 is suppressed.

Returning to FIG. 4, a recess portion 23 is formed in a manner of drilling an upper surface from the front foot portion to the middle foot portion of the midsole 20. A cushion member 25 conforming to the recess portion 23 is fitted in the recess portion 23. The cushion member 25 includes a joint cushion portion 25*a* corresponding to the MP joint Ja of the foot and provided along the entire width in the width direction X and a lateral cushion portion 25*b* extending from the joint cushion portion 25*a* to a lateral rear side. Meanwhile, the recess portion 23 and the cushion member 25 may be dispensed with, and the part of the cushion member 25 may be formed integrally with use of the same material as that for the midsole 20.

The plate member 30 is made of a material having higher rigidity than the other part of the sole and is formed in a thin plate shape having a large outside dimension in the width direction X at the middle foot portion and extending to narrow toward the front foot and the rear foot as illustrated in FIG. 4. In the plate member 30, at the middle foot portion, curved and strip-like medial member 31 and lateral member 32 are formed to extend in the front-rear direction, and a through hole penetrating in the up-down direction is formed between the medial member 31 and the lateral member 32. The medial member 31 and the lateral member 32 are connected at the front foot portion by a reinforcing member 33 inclined to extend backward from the medial side to the lateral side in the width direction. A dimension W1 of the medial member 31 in the width direction X is longer than a dimension W2 of the lateral member 32 in the width direction X.

The toe sole portion 11 of the outer sole 10 is made of rubber, rubber foam, or thermoplastic and thermosetting elastomer, for example. The sole main body portion 12 is made of rubber, rubber foam, or thermoplastic and thermosetting elastomer, for example, and may contain a thermoplastic resin such as thermoplastic polyurethane (TPU). The midsole 20 is made of resin-made foam, for example. The resin is a thermoplastic resin or the like such as polyolefin resin and ethylene-vinyl acetate copolymer (EVA). The midsole 20 may contain another arbitrary component such as fiber as needed. The cushion member 25 is made of resin-made foam, for example. For the cushion member 25, foam such as polyolefin resin, EVA, and styrene elastomer is used. For the plate member 30, glass fiber reinforced plastic or other fiber reinforced plastic is used, and thermoplastic and thermosetting elastomer may additionally be used.

For example, in the outer sole 10, the hardness of the toe sole portion 11 is HA62, and the hardness of the sole main body portion 12 is HA70. Also, for example, the hardness of the midsole 20 is HC57, and the hardness of the cushion member 25 is HC50. The plate member 30 has the elastic modulus of 2.87 GPa, for example, to secure high rigidity and has higher hardness than the midsole 20.

Next, effects of the shoe 100 will be described.

Figure 7A:
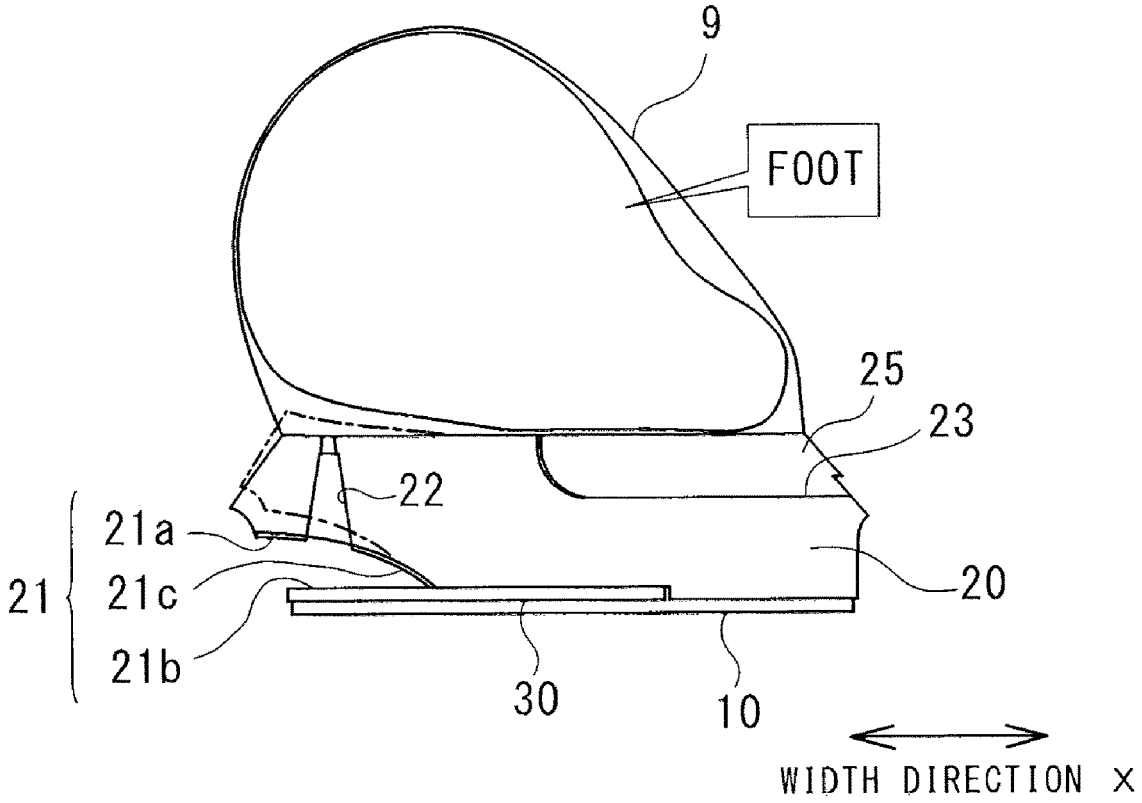
FIGS. 7A and 7B are schematic views describing a fitting feature of the sole to an arch portion.
Figure 7B:
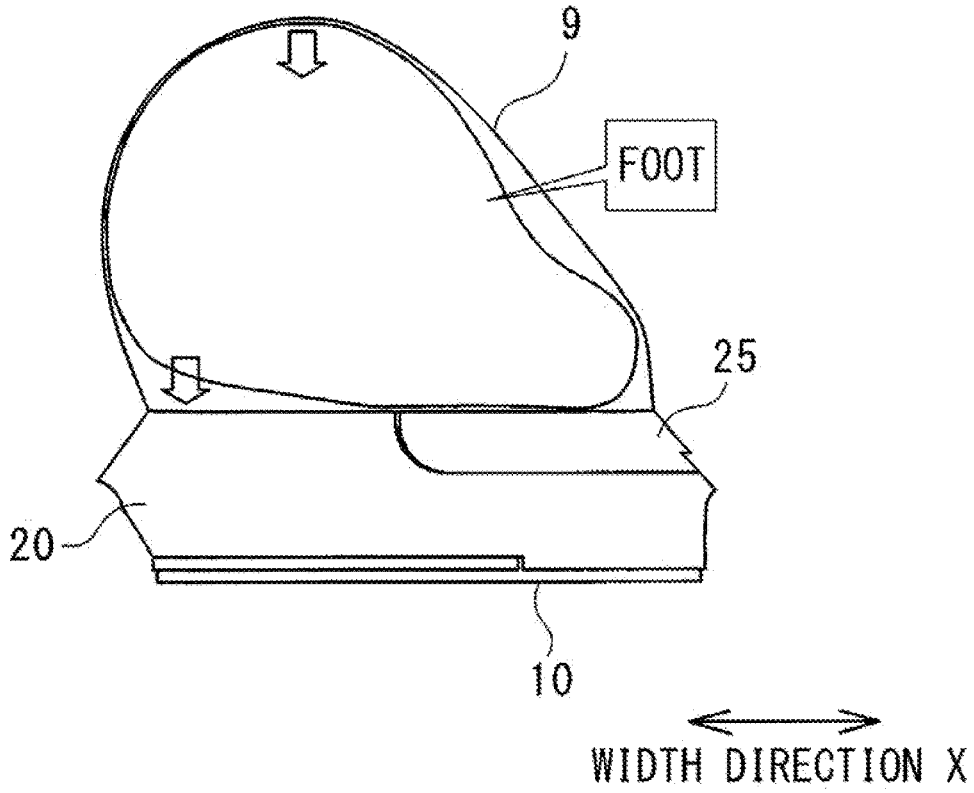

FIGS. 7A and 7B are schematic views describing a fitting feature of the sole 1 to the arch portion. When the wearer puts on the shoe 100 and ties the shoelaces, the medial side of the sole 1 at the middle foot portion is deformed as illustrated by the dashed-dotted line in FIG. 7A and fits the arch portion. Since the midsole 20 located on the upper side of the cut-out portion 21 is thinner and less rigid than the front part or the rear part of the cut-out portion 21, the midsole 20 is easily deformed. Since, on the medial side of the midsole 20 at the middle foot portion, the midsole 20 is deformed to go upward, sinking of the medial longitudinal arch can be reduced. Conversely, in a case in which the cut-out portion 21 is not provided as illustrated in FIG. 7B, the foot is pressed downward by the upper 9 as a result of tying of the shoelaces, and sinking of the medial longitudinal arch is generated. Also, by providing a similar cut-out portion to the cut-out portion 21 on the lateral side as well, sinking of the lateral longitudinal arch can be reduced. In a case of providing the cut-out portion 21 on the medial side or on the lateral side, a similar sinking reducing effect can be obtained. However, providing the cut-out portion 21 on the medial side has a secondary effect on many wearers and is highly effective. That is, in terms of inclination of the ankle part, a large number of people have a tendency toward pronation, in which the ankle is inclined to the medial side, the next highest number of people have a tendency toward neutral, and a small number of people have a tendency toward supination, in which the ankle is inclined to the lateral side. Hence, reduction of sinking on the medial side has a secondary effect causing improvement of the pronation. On the other hand, reduction of sinking on the lateral side is effective to so-called bow-legged people.

The lower surface portion 21*b* of the cut-out portion 21 is made of the plate member 30, has higher hardness than the upper surface portion 21*a*, and suppresses bending deformation on the outer sole side. The plate member 30 is provided to extend from the front foot portion to the rear foot portion and suppresses bending deformation from the front portion to the rear portion of the sole 1. Also, by arranging the plate member 30 on the lower side of the cut-out portion 21 of the midsole 20, impact on the bottom of the foot due to unevenness of the ground can be suppressed. From a viewpoint of suppression of sinking of the arch of the foot, the outer sole 10 has only to be provided on the lower side of the cut-out portion 21, and the plate member 30 may not be provided. In a case in which the plate member 30 is not provided, the outer sole 10 located on the lower side of the cut-out portion 21 acts as the lower surface portion 21*b* of the cut-out portion 21 and functions as a deformation suppressing portion instead of the plate member 30. Also, to heighten the hardness and the rigidity of this part, the outer sole 10 may partially be thickened, be provided with a reinforcing rib, or be made of another material.

Also, as illustrated in FIG. 7, the vent hole 22 is provided to penetrate the midsole 20 in the up-down direction and thus functions as a water entry suppressing portion suppressing water entry into the shoe 100. Here, the up-down direction is not limited to a vertical direction. The vent hole 22 has only to penetrate so that air can pass therethrough in the up-down direction. For this reason, the vent hole 22 may be formed in a crank shape or in a labyrinth shape in a cross-sectional view. Also, since the vent hole 22 is provided in the middle portion of the cut-out portion 21 in the width direction, the vent hole 22 has a space of the cut-out portion 21 therebelow, water entering the vent hole 22 drops into the space, and water entry into the shoe 100 is suppressed. Also, in a case in which the upper surface portion 21*a* or the lower surface portion 21*b* is provided with the projecting portion as described above, the deformation suppressing effect at the upper surface portion 21*a* or the lower surface portion 21*b* is improved. Further, by providing the projecting portion further on the medial side in the width direction X than the vent hole 22, water entry into the vent hole 22 is suppressed.

The cushion member 25 alleviates by means of the joint cushion portion 25*a* (refer to FIG. 4) impact and an increase of local load when the wearer's weight is applied to the MP joint Ja of the foot. Also, when the weight is applied to the lateral side of the middle foot portion, the cushion member 25 alleviates by means of the lateral cushion portion 25*b* the impact and the high load. Further, the cushion member 25 is appropriately deformed at the time of kicking for running to heighten a biasing force to the front side.

Also, in the plate member 30 illustrated in FIG. 4, the reinforcing member 33 reinforces the plate member 30 against deformation of the plate member 30 in which the heel side is twisted inward with respect to the toe side. Also, when the weight moves from the heel portion to the toe side, higher load is applied to the thenar side than to the hypothenar side. Thus, in order for the sole 1 to bend similarly on the medial side and on the lateral side at the time of kicking, the dimension W1 of the medial member 31 in the width direction X is longer than the dimension W2 of the lateral member 32 in the width direction X. Instead of making the dimension W1 of the medial member 31 in the width direction X longer than that of the lateral member 32, the medial member 31 may be thicker than the lateral member 32, or a rib may be provided to heighten the rigidity. Also, the medial member 31 and the lateral member 32 may be connected on the toe side as illustrated in FIG. 4 or may not be connected.

FIGS. 8A, 8B, 8C, 8D and 8E are schematic views illustrating modification examples of the plate member 30. FIGS. 8A, 8B, 8C, 8D and 8E are plan views of the plate member 30. In the plate member 30 illustrated in FIG. 8A, the reinforcing member 33 is inclined to extend forward from the medial side to the lateral side in the width direction. The MP joint portion of the human foot on the little finger side is located further on the heel side than that on the thumb side. Thus, at the time of kicking by lifting the heel, the heel portion tends to be twisted outward with respect to the toe. The plate member 30 has the effect of weight reduction due to the through hole at the center portion and has the effect of suppression, by means of the reinforcing member 33, of deformation in which the heel side is twisted outward with respect to the toe side, to guide the kicking direction to the running direction.

Figure 8A:
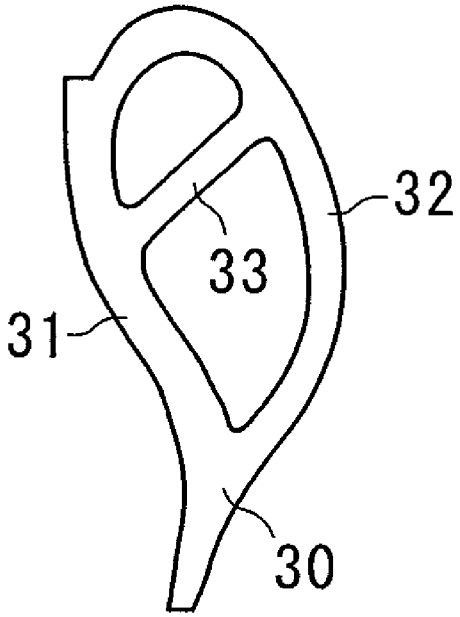
FIGS. 8A, 8B, 8C, 8*d* and 8E are schematic views illustrating modification examples of a plate member.
Figure 8B:
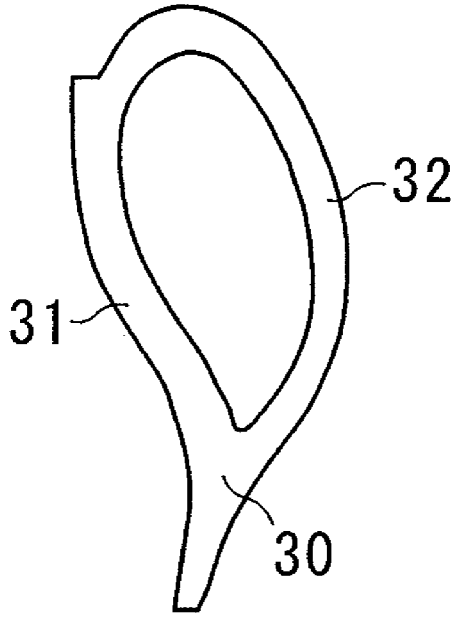
Figure 8C:
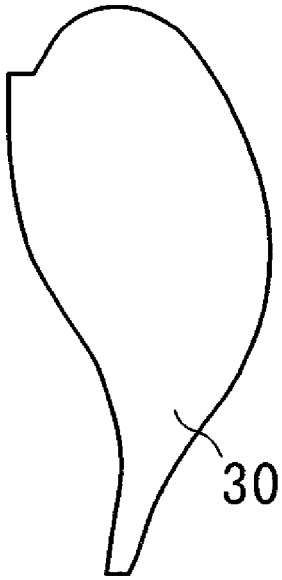
Figure 8D:
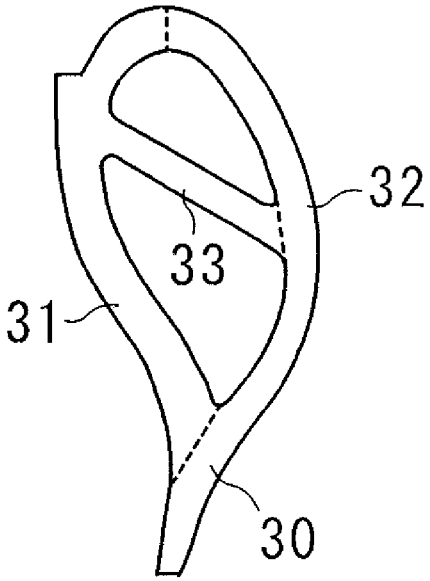
Figure 8E:
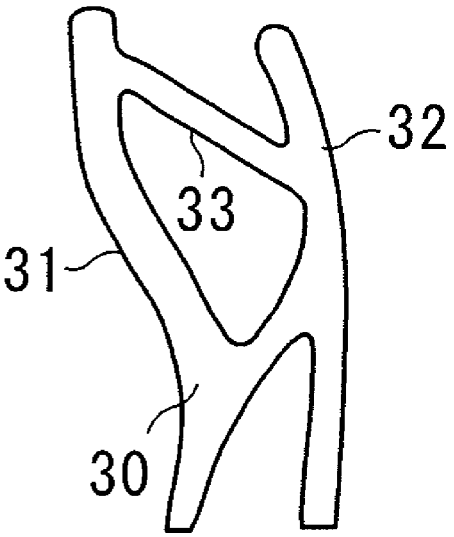

FIG. 8B illustrates a case in which the plate member 30 is not provided with the reinforcing member 33. In a case in which the plate member 30 has sufficient strength for movement of the foot, the reinforcing member 33 is dispensed with. Since the plate member 30 is not provided with the reinforcing member 33, weight reduction is achieved. FIG. 8C illustrates a case in which the plate member 30 is not provided with a hole at the center. The entire plate member 30 is improved in rigidity and is reinforced. FIG. 8D illustrates a case in which, in the plate member 30, different materials are used for the right and the left illustrated by the dashed line. The shape is similar to that of the plate member 30 illustrated in FIG. 4. Since the human foot has the medial longitudinal arch, the medial side is easy to deform, and load on the thenar side is high, the heel portion is twisted inward with respect to the toe in the middle of a support period during running. Since the plate member 30 achieves weight reduction and suppresses inward twist by means of the reinforcing member 33, the amount of deformation of the front foot portion can be reduced, the energy loss can be reduced, and the ground contact period can be shortened. FIG. 8E illustrates a case in which, in the plate member 30, the front portion is not connected, and in which the rear portion is provided on the medial side and on the lateral side with parts extending in the front-rear direction. The rigidity of the portion provided with the plate member 30 is heightened.

Second Embodiment

Figure 9:
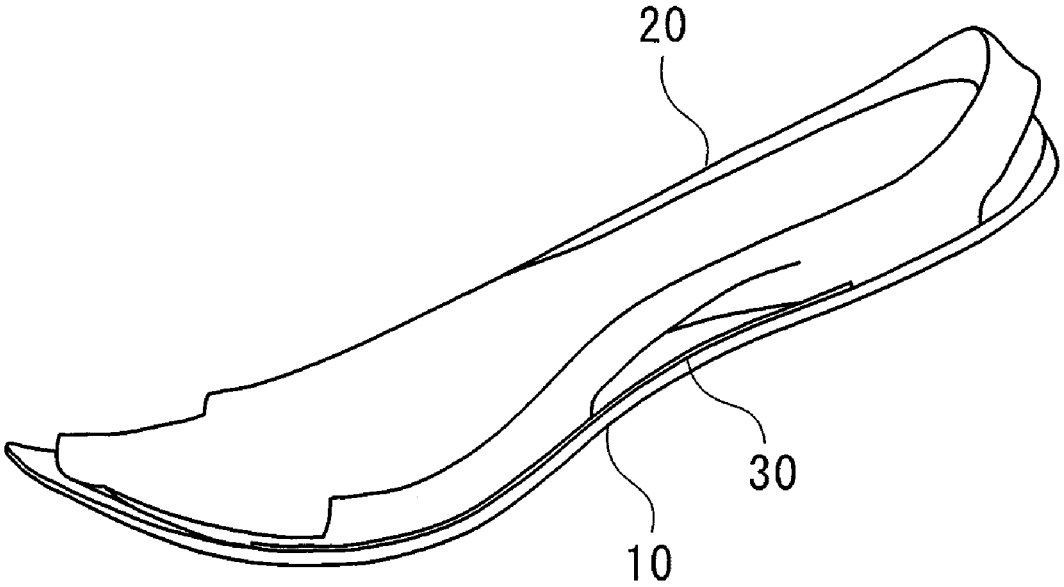
FIG. 9 is a perspective view illustrating an external view of the sole according to a second embodiment.
Figure 10:
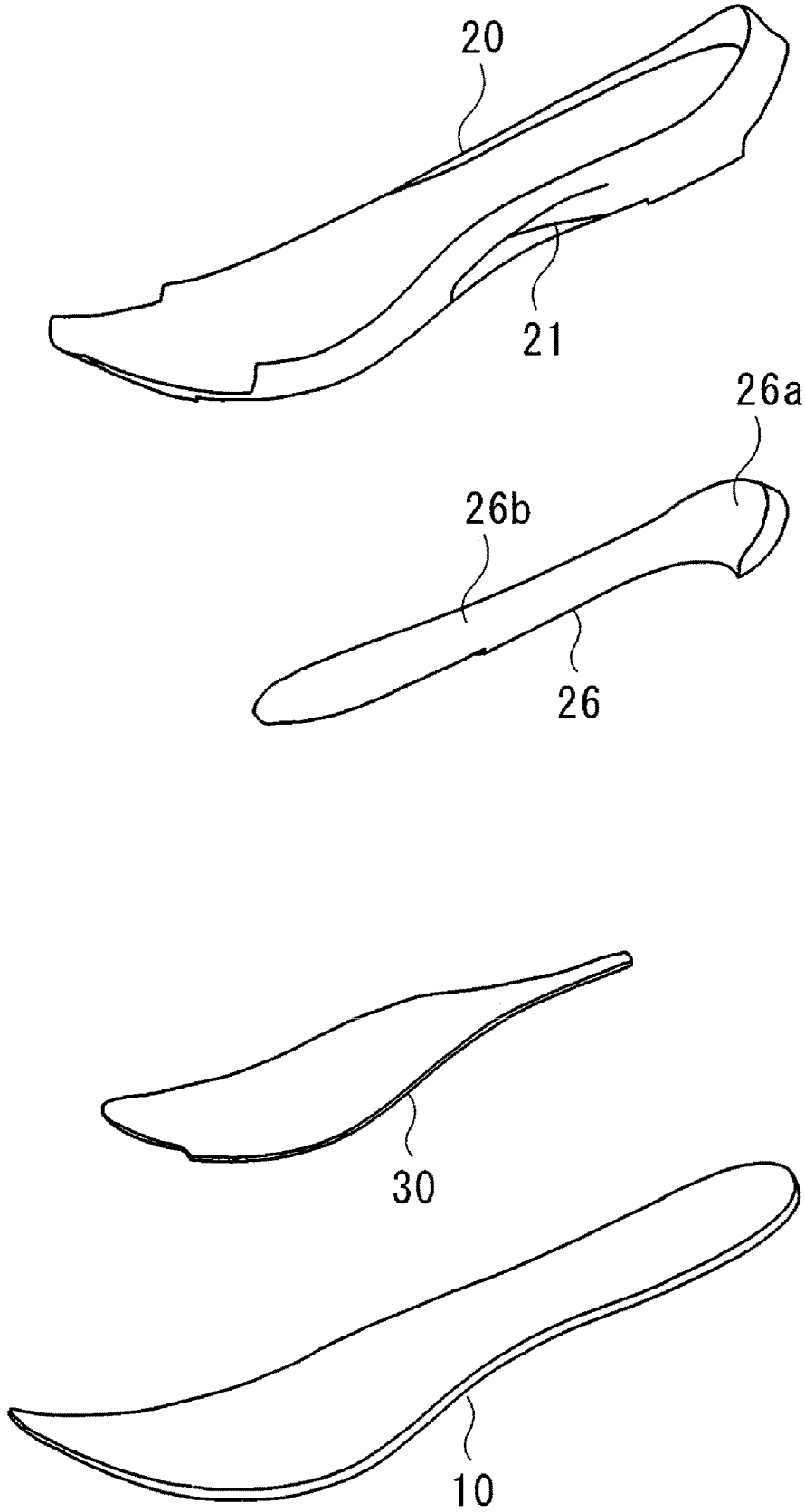
FIG. 10 is an exploded perspective view of the sole.

FIG. 9 is a perspective view illustrating an external view of the sole 1 according to a second embodiment, and FIG. 10 is an exploded perspective view of the sole 1. To the sole 1, the upper 9 as illustrated in FIG. 1 is connected to constitute a shoe. The sole 1 according to the second embodiment includes the outer sole 10, the midsole 20, and the plate member 30 in a similar manner to the first embodiment and is provided with a cushion member 26 extending from the heel portion to a front portion of the middle foot portion on the lateral side. Meanwhile, on the medial side of the middle foot portion of the midsole 20, the cut-out portion 21 is formed in a similar manner to the first embodiment. The configuration and effect of the cut-out portion 21 are similar to those of the first embodiment, and description thereof is omitted for simplification.

The cushion member 26 is arranged on the lower side of the midsole 20 to be interposed between the midsole 20 and the outer sole 10. The cushion member 26 includes a heel cushion portion 26*a* arranged at the heel portion and a lateral cushion portion 26*b* extending from the heel cushion portion 26*a* to the front portion of the middle foot portion on the lateral side. The materials, hardness, and the like of the outer sole 10, the midsole 20, the cushion member 26, and the plate member 30 may be similar to those described in the first embodiment, for example.

The heel cushion portion 26*a* alleviates impact and an increase of local load generated when the wearer's weight is applied when the wearer lands on the heel portion. Also, the lateral cushion portion 26*b* alleviates impact and an increase of load caused by the weight applied to the lateral side of the foot when the weight shifts from the heel portion to the toe side.

Although the cushion member 26 illustrated in FIGS. 9 and 10 is arranged on the lower side of the midsole 20, the cushion member 26 may be arranged on the upper side of the midsole 20. Also, the joint cushion portion 25*a* illustrated in the first embodiment may additionally be provided. Gel is preferably used for the cushion member 26, and an additional midsole which is softer than the midsole 20 may be used.

Third Embodiment

Figure 11A:
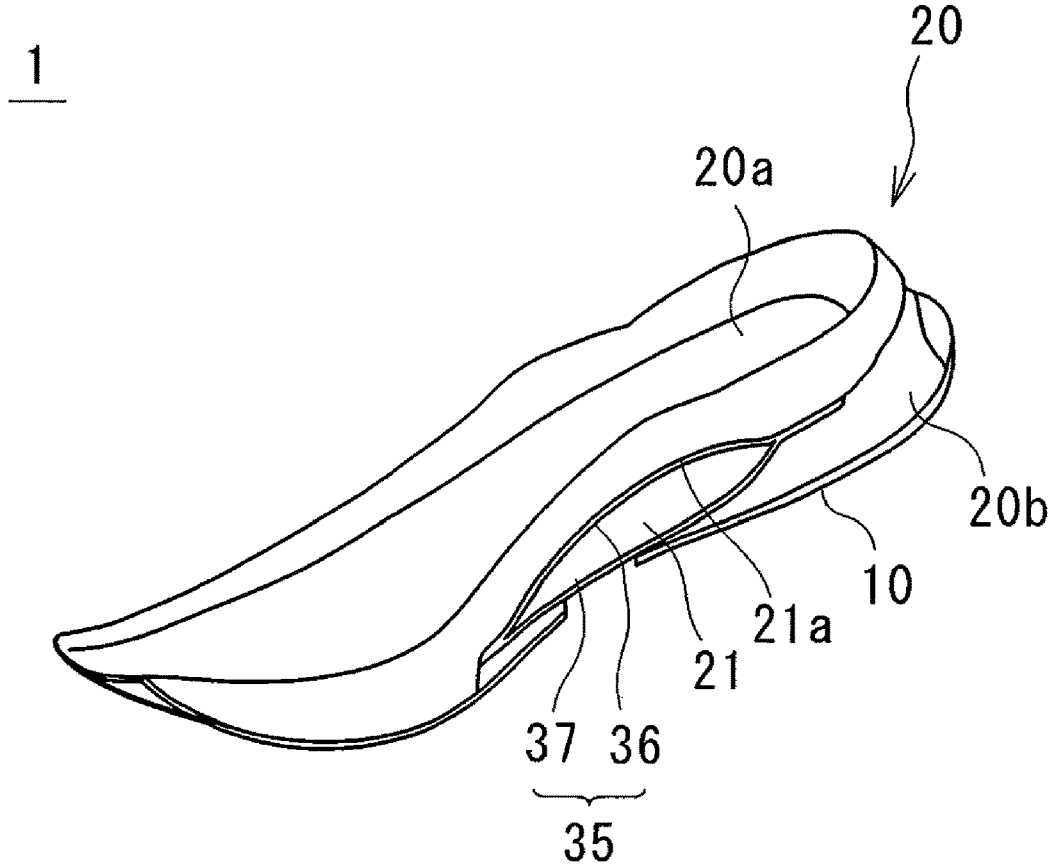
FIG. 11A is a perspective view illustrating an external view of the sole according to a third embodiment as seen from medial side.
Figure 11B:
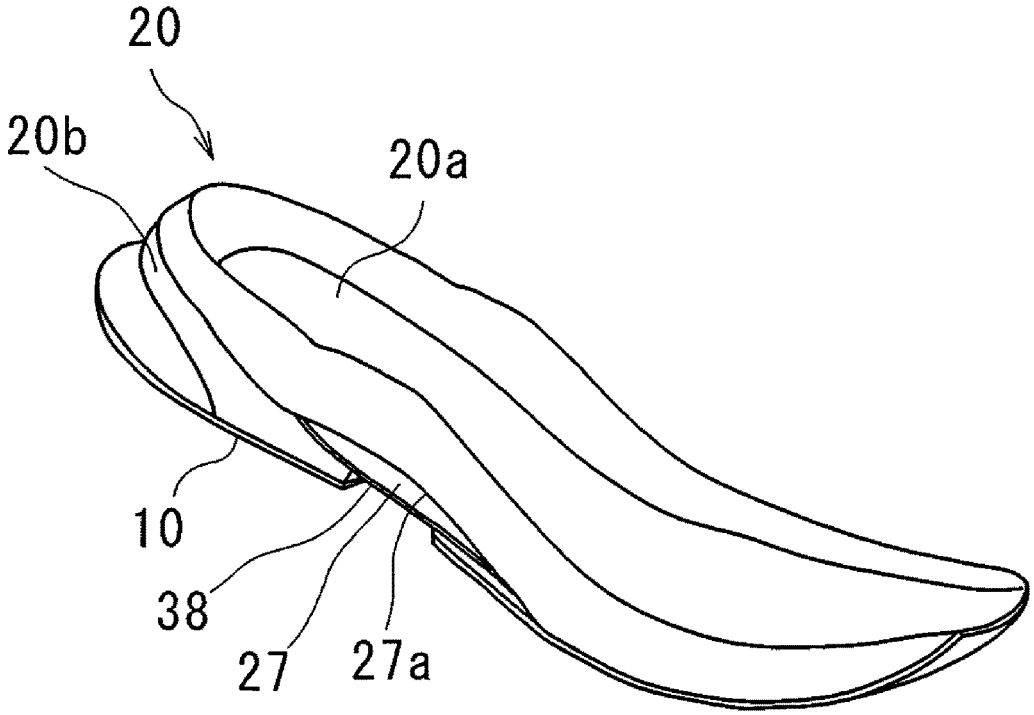
FIG. 11B is a perspective view illustrating an external view of the sole according to the third embodiment as seen from lateral side.
Figure 12A:
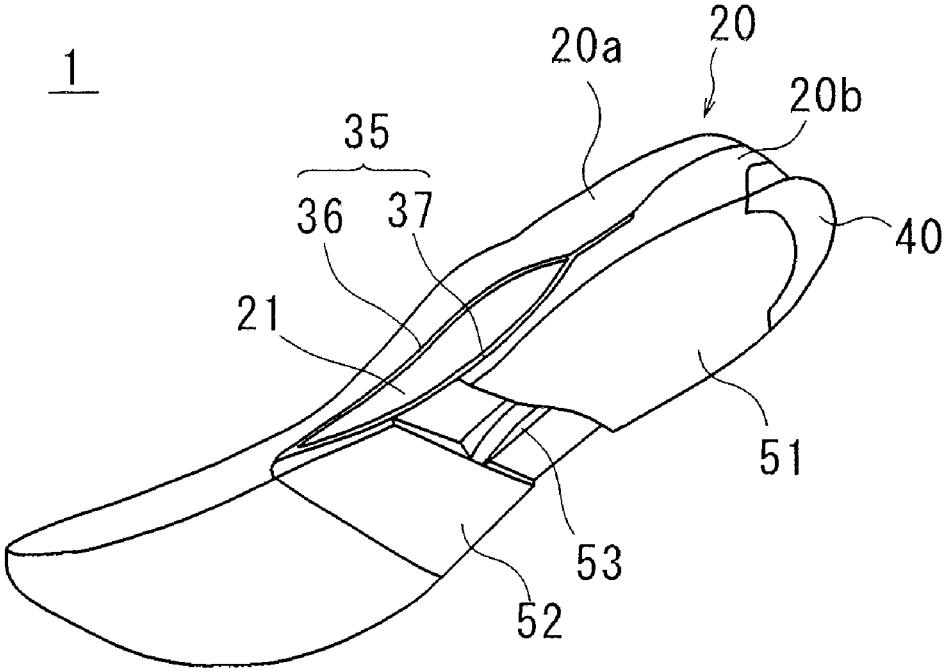
FIG. 12A is a perspective view illustrating an external view of the sole except an outer sole 10 as seen from lower medial side.
Figure 12B:
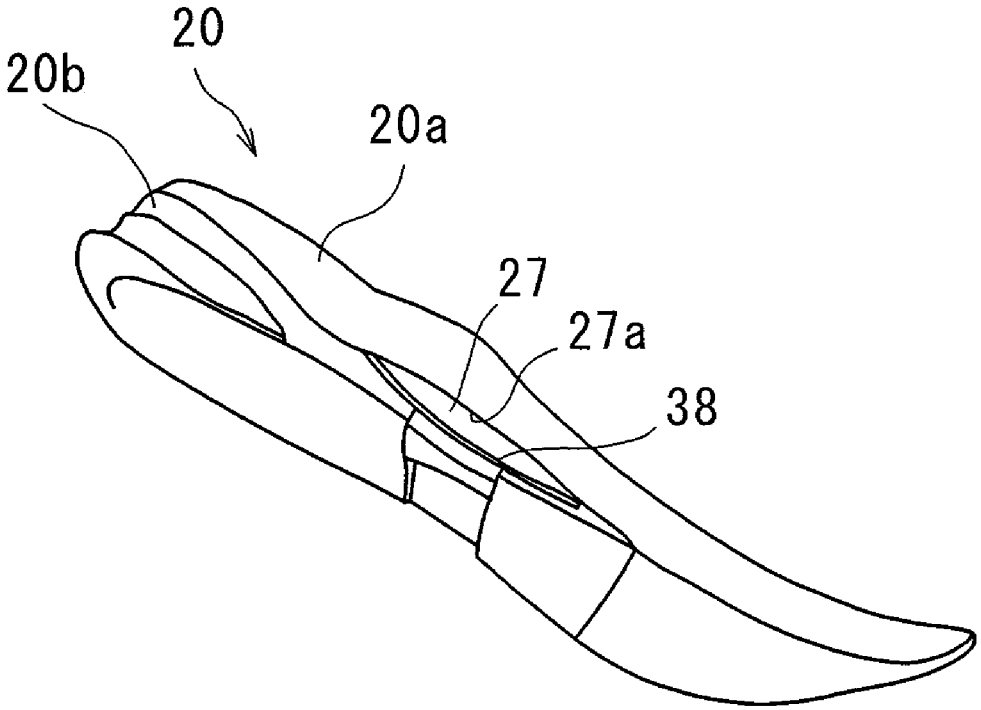
FIG. 12B is a perspective view illustrating an external view of the sole except the outer sole 10 as seen from lower lateral side.

FIG. 11A is a perspective view illustrating an external view of the sole 1 according to a third embodiment as seen from medial side, and FIG. 11B is a perspective view illustrating an external view of the sole 1 according to the third embodiment as seen from lateral side. Also, FIG. 12A is a perspective view illustrating an external view of the sole 1 except the outer sole 10 as seen from the lower medial side, and FIG. 12B is a perspective view illustrating an external view of the sole 1 except the outer sole 10 as seen from the lower lateral side. To the sole 1, the upper 9 as illustrated in FIG. 1 is connected to constitute a shoe. The sole 1 according to the third embodiment includes the outer sole 10, the midsole 20, a deformation suppressing member 35, and the like and is provided with the cut-out portion 21 on the medial side and a cut-out portion 27 on the lateral side to reduce sinking of the medial longitudinal arch and the lateral longitudinal arch of the foot when the wearer wears the shoe.

The midsole 20 includes an upper midsole 20*a* and a lower midsole 20*b*. The upper midsole 20*a* is formed from the toe to the heel. In the lower midsole 20*b*, a rear foot sole portion 51 and a middle foot sole portion 52 are provided to be away from each other, and the rear foot sole portion 51 and the middle foot sole portion 52 are connected by a connecting portion 53 extending in the front-rear direction at the center portion in the width direction X. On the rear side of the rear foot sole portion 51, a heel member 40 is arranged to extend from the rear portion of the heel portion to the lateral side of the heel portion.

The heel member 40 may be arranged to extend from the rear portion of the heel portion to the medial side of the heel portion. The heel member 40 is made of rubber, rubber foam, or thermoplastic and thermosetting elastomer, for example, in consideration of abrasion resistance in a similar manner to the outer sole 10. Although the hardness of the heel member 40 is preferably lower than that of the outer sole 10 to alleviate impact at the time of landing, the hardness of the heel member 40 may be higher than that of the outer sole 10 to suppress abrasion.

The upper midsole 20*a* is arranged on the lower midsole 20*b* and is formed from the toe to the heel. The upper midsole 20*a* is covered with the lower midsole 20*b* on the bottom sides of the rear foot portion and the middle foot portion.

On the medial side of the middle foot portion of the midsole 20, the cut-out portion 21 is formed in a similar manner to the first embodiment. Also, the midsole 20 according to the third embodiment includes the cut-out portion 27 on the lateral side of the middle foot portion as well. The cut-out portion 21 is formed in a manner of being drilled from the medial side of the middle foot portion with an upper surface portion 21*a* left, and the medial side and the bottom side are opened. The cut-out portion 27 is formed in a manner of being drilled from the lateral side of the middle foot portion with an upper surface portion 27*a* left, and a lateral side and a bottom side are opened. The cut-out portion 21 and the cut-out portion 27 are closed on the bottom sides by the deformation suppressing member 35 arranged on the lower side and are opened on the medial side and on the lateral side, respectively.

Figure 13A:
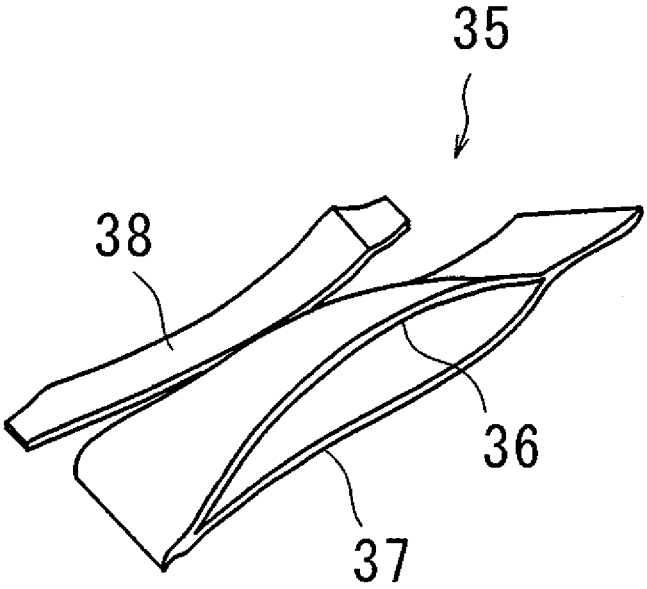
FIG. 13A is a perspective view illustrating an external view of a deformation suppressing portion.
Figure 13B:
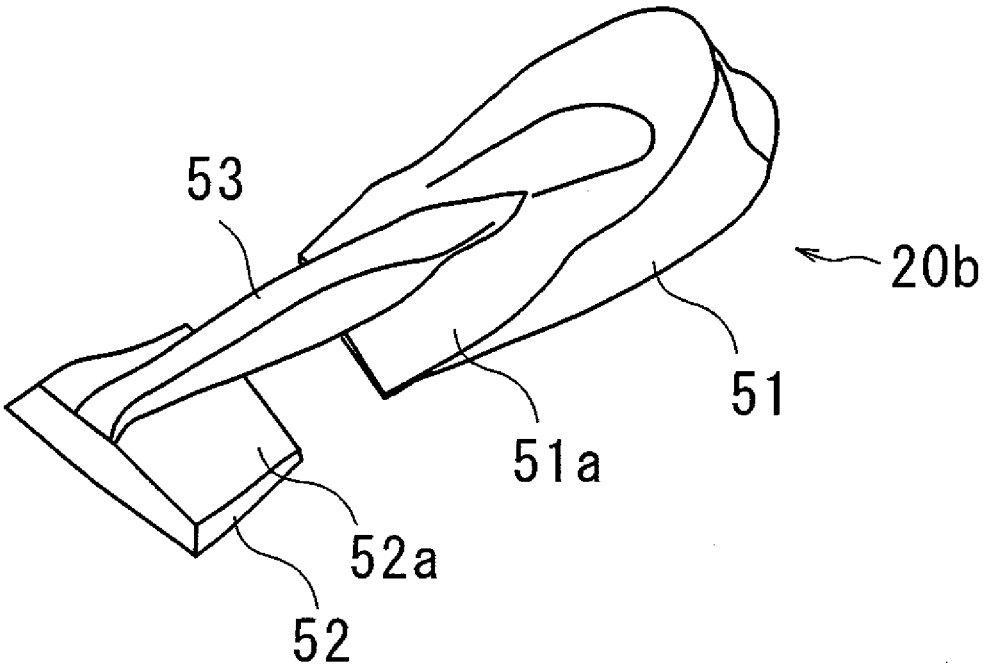
FIG. 13B is a perspective view illustrating an external view of a lower midsole.

FIG. 13A is a perspective view illustrating an external view of the deformation suppressing member 35, and FIG. 13B is a perspective view illustrating an external view of the lower midsole 20*b*. The deformation suppressing member 35 includes a plate-like medial upper deformation suppressing portion 36 arranged along the upper surface portion 21*a* of the cut-out portion 21 in the midsole 20 and a plate-like medial lower deformation suppressing portion 37 arranged on the lower side of the medial upper deformation suppressing portion 36. The medial upper deformation suppressing portion 36 is formed to be curved as seen from the medial side to be in a recessed shape facing the lower side. The medial lower deformation suppressing portion 37 may be formed in an uneven line as seen from the medial side.

The medial lower deformation suppressing portion 37 is formed to be curved as seen from the medial side to be in a recessed shape facing the upper side, is most away from the medial upper deformation suppressing portion 36 at the center portion in the front-rear direction Y, and is connected to the medial upper deformation suppressing portion 36 at the front portion and at the rear portion. The medial lower deformation suppressing portion 37 may be formed in a straight line or in an uneven line as seen from the medial side. The cut-out portion 21 is closed on the bottom side by the medial lower deformation suppressing portion 37.

Also, the deformation suppressing member 35 includes on the lateral side of the middle foot portion a plate-like lateral lower deformation suppressing portion 38 forming a lower surface part of the cut-out portion 27 of the midsole 20. The cut-out portion 27 is closed on the bottom side by the lateral lower deformation suppressing portion 38. Although the lateral lower deformation suppressing portion 38 illustrated in FIG. 13A is formed as a separate portion from the medial upper deformation suppressing portion 36 and the medial lower deformation suppressing portion 37, the lateral lower deformation suppressing portion 38 may be connected thereto at least either on the front side or on the rear side.

The deformation suppressing member 35 is mounted on an upper surface 51*a* (refer to FIG. 13B) of the rear foot sole portion 51 in the lower midsole 20*b* and on an upper surface 52*a* of the middle foot sole portion 52 and is interposed between the lower midsole 20*b* and the upper midsole 20*a*. Meanwhile, the cut-out portion 21 and the cut-out portion 27 do not communicate in the width direction and are closed at the center portion in the width direction at least by the connecting portion 53 of the lower midsole 20*b*.

Next, effects of the sole 1 according to the third embodiment will be described. Since the sole 1 includes the cut-out portion 21 and the cut-out portion 27 on the medial side and the lateral side of the middle foot portion, the sole 1 reduces sinking of the medial longitudinal arch and the lateral longitudinal arch of the foot when the wearer puts on the shoe 100 and ties the shoelaces.

Also, since the medial upper deformation suppressing portion 36 provided on the upper surface portion 21*a* of the cut-out portion 21 is made of a material having higher hardness than that of the midsole 20, for example, deformation of the upper surface portion 21*a* to the lower side can be suppressed. Deformation of the upper surface portion 21*a* to the lower side can also be suppressed by forming the medial upper deformation suppressing portion 36 in a shape that causes the medial upper deformation suppressing portion 36 to have higher rigidity than that of the upper surface portion 21*a* of the cut-out portion 21 (for example, in a shape having a rib).

Next, characteristics of the shoe 100 according to the embodiments and the modification examples will be described.

The shoe 100 includes the outer sole 10 brought in contact with the road surface, the midsole 20 arranged on the outer sole 10, and the upper 9 covering the foot from the upper side. The midsole 20 includes at the middle foot portion the cut-out portion 21 and the like opened to the lateral side and closed at the middle portion in the width direction. Accordingly, in the shoe 100, since the cut-out portion 21 is opened, the midsole 20 fits the middle foot portion of the foot, and sinking of the medial longitudinal arch and the lateral longitudinal arch can be reduced.

The cut-out portion 21 is provided at the medial side portion. Accordingly, the shoe 100 can reduce sinking of the medial longitudinal arch corresponding to the arch portion.

Also, the plate member 30 having hardness or rigidity equal to or higher than that of the upper surface side and serving as a deformation suppressing portion is provided on the lower surface side of the cut-out portion 21. Accordingly, the shoe 100 can suppress bending deformation on the side of the outer sole 10.

Also, the plate member 30 is formed in a plate shape and is provided to extend from the front side to the rear side on the lower surface side of the cut-out portion 21. Accordingly, bending deformation of the shoe 100 from the front side to the rear side on the lower surface side of the cut-out portion 21 can be suppressed.

Also, the plate member 30 is enlarged in the width direction at the middle foot portion, is provided at the center portion with the hole penetrating in the up-down direction, and has a longer dimension of the medial member 31 serving as a medial part in the width direction X than that of the lateral member 32. Accordingly, the medial side and the lateral side of the shoe 100 can be bent equally.

Also, the cut-out portion 21 includes the medial upper deformation suppressing portion 36 serving as an upper deformation suppressing portion suppressing deformation of the upper surface side to the lower side. Accordingly, in the shoe 100, deformation of the cut-out portion 21 to the lower side can be suppressed.

Also, the vent hole 22 is provided to penetrate the midsole 20 from the inside surface of the cut-out portion 21. Accordingly, in the shoe 100, a ventilation characteristic in the inside can be secured.

Also, the vent hole 22 is provided to extend in the up-down direction to suppress water entry from the outside. Accordingly, in the shoe 100, water entry into the inside can be suppressed.

The present invention has been described based on the embodiments. It is to be understood by those skilled in the art that the present embodiments are illustrative, that various modifications and alterations are available within the scope of the patent claims of the present invention, and that such modification examples and alterations are within the scope of the patent claims of the present invention. Accordingly, the description and drawings in the present specification shall be treated not in a limited manner but for illustrative purposes.

DESCRIPTION OF THE REFERENCE NUMERALS

10 outer sole, 20 midsole, 21, 27 cut-out portion, 22 vent hole, 30 plate member (deformation suppressing portion), 31 medial member (medial part), 32 lateral member (lateral part), 36 medial upper deformation suppressing portion (upper deformation suppressing portion), 9 upper, 100 shoe

INDUSTRIAL APPLICABILITY

The present invention relates to a shoe.

The invention claimed is:

1. A shoe comprising:

an outer sole configured to be brought in contact with a road surface;

a midsole arranged on the outer sole;

a plate member positioned between the outer sole and the midsole; and an upper configured to cover a foot from an upper side;

wherein the midsole includes at a middle foot portion a cut-out portion opened to a medial side and closed at a middle portion in a width direction, and closed at a front side and a rear side in a length direction so that the cut-out portion is configured to be positioned corresponding to an arch portion of the foot, wherein the cut-out portion includes an upper side including an exposed portion of the midsole and a lower side closed by the plate member;

wherein the plate member is provided to extend from the front side to the rear side on the lower side of the cut-out portion;

wherein the plate member is enlarged in the width direction at the middle foot portion, is provided at a center portion with a hole penetrating in an up-down direction, and has a longer width dimension of a medial part than that of a lateral part; and wherein the middle portion in the width direction where the cut-out portion is closed is positioned closer to the medial side of the shoe than to a lateral side of the shoe.

2. The shoe according to claim 1, wherein the plate member includes a hardness higher than a hardness of the exposed portion of the midsole.

3. The shoe according to claim 1, wherein a vent hole is provided to penetrate through an uppermost surface of the midsole from an inside surface of the cut-out portion.

4. The shoe according to claim 3, wherein the vent hole is provided to extend in an up-down direction to suppress water entry from an outside.

5. The shoe according to claim 1, wherein the plate member extends in a foot length direction to a first position forward of the cut-out portion toward a front end of the shoe and to a second position behind the cut-out portion toward a rear end of the shoe.

6. A shoe comprising:

an outer sole including an upper surface and a lower surface, the lower surface configured to be brought in contact with a road surface;

a midsole arranged on the outer sole;

a plate member positioned between the outer sole and the midsole, the plate member including an upper surface facing the midsole and a lower surface facing the upper surface of the outer sole; and an upper configured to cover a foot from an upper side;

wherein the midsole includes a cut-out portion opened to a medial side and closed at a middle portion in a width direction, wherein the cut-out portion is closed at a front side and a rear side in a length direction, wherein no portion of the midsole is positioned between the lower surface of the plate member and the upper surface of the outer sole, and wherein the cut-out portion is configured to be positioned corresponding to an arch portion of the foot;

wherein the cut-out portion includes an upper side including an exposed portion of the midsole and a lower side closed by the plate member;

wherein the plate member is provided to extend along an entire length of the cut-out portion;

wherein the plate member is provided at a center portion with a hole penetrating in an up-down direction, and wherein the plate member has a longer width dimension of a medial part than that of a lateral part; and wherein the middle portion in the width direction where the cut-out portion is closed is positioned closer to the medial side than to a lateral side of the shoe.

7. The shoe according to claim 6, wherein an entire upper side of the cut-out portion from an outer edge to the middle portion where the cut-out portion is closed includes an exposed portion of the midsole.

8. The shoe according to claim 6, wherein the cut-out portion is configured to be positioned only corresponding to the arch portion of the foot, when the foot is fully inserted into the shoe.

9. The shoe according to claim 6, wherein the plate member includes a rigidity higher than a rigidity of the exposed portion of the midsole.

10. The shoe according to claim 6, wherein a vent hole is provided to penetrate through an uppermost surface of the midsole from an inside surface of the cut-out portion.

11. The shoe according to claim 10, wherein the vent hole is provided to extend in an up-down direction to suppress water entry from an outside.

12. The shoe according to claim 6, wherein the plate member extends in a foot length direction to a first position forward of the cut-out portion toward a front end of the shoe and to a second position behind the cut-out portion toward a rear end of the shoe.

* * * * *